US011287761B2

(12) United States Patent
Itabashi

(10) Patent No.: US 11,287,761 B2
(45) Date of Patent: Mar. 29, 2022

(54) IMAGE FORMING APPARATUS HAVING SENSOR TO DETECT WHETHER DEVELOPING ROLLER IS AT SEPARATION POSITION

(71) Applicant: BROTHER KOGYO KABUSHIKI KAISHA, Nagoya (JP)

(72) Inventor: Nao Itabashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/032,863

(22) Filed: Sep. 25, 2020

(65) Prior Publication Data

US 2021/0011395 A1 Jan. 14, 2021

Related U.S. Application Data

(63) Continuation of application No. PCT/JP2019/002435, filed on Jan. 25, 2019.

(30) Foreign Application Priority Data

Mar. 30, 2018 (JP) ..... JP2018-068149

(51) Int. Cl.
*G03G 15/08* (2006.01)

(52) U.S. Cl.
CPC ..... *G03G 15/0808* (2013.01); *G03G 15/0896* (2013.01)

(58) Field of Classification Search
CPC ..... G03G 15/0808; G03G 15/0896
See application file for complete search history.

(56) References Cited

U.S. PATENT DOCUMENTS 8,081,886 B2 * 12/2011 Okano
2009/0214241 A1 * 8/2009 Kawaguchi et al.
(Continued)

FOREIGN PATENT DOCUMENTS

JP 2005-62606 A 3/2005
JP 2007047314 A * 2/2007 ..... G03G 15/0868
(Continued)

OTHER PUBLICATIONS

Machine translation of Toyoshima, JP 2018-045045 (2108).*
(Continued)

*Primary Examiner* — Sevan A Aydin
(74) *Attorney, Agent, or Firm* — Merchant & Gould P.C.

(57) ABSTRACT

In an image forming apparatus, a separation mechanism moves a developing roller from a contact position to a separation position. At the contact position a surface of the developing roller is in contact with a surface of a photosensitive drum. At the separation position the surface of the developing roller is separated from the surface of the photosensitive drum. A sensor detects whether the developing roller is at the separation position. A controller executes a transmission process transmitting to the motor a command to drive the separation mechanism, a determination process determining whether or not the sensor detects that the developing roller is positioned at the separation position within a predetermined period of time after the command is transmitted in the transmission process, and a stop process stopping image formation operation in a case where the sensor does not detect that the developing roller is positioned at the separation position.

10 Claims, 6 Drawing Sheets

(56) References Cited

U.S. PATENT DOCUMENTS

| | | | | |
|---|---|---|---|---|
| 2013/0279921 | A1* | 10/2013 | Kanai et al. | |
| 2015/0117874 | A1* | 4/2015 | Shiraki | |
| 2016/0179051 | A1 | 6/2016 | Kim et al. | |
| 2017/0248910 | A1 | 8/2017 | Hayakawa et al. | |
| 2018/0284688 | A1* | 10/2018 | Shimizu | G03G 21/1676 |
| 2019/0137904 | A1* | 5/2019 | Jung et al. | |
| 2019/0369539 | A1* | 12/2019 | Park et al. | |
| 2021/0080861 | A1* | 3/2021 | Shimizu | G03G 15/0856 |
| 2021/0080862 | A1* | 3/2021 | Kusano | G03G 21/1814 |

FOREIGN PATENT DOCUMENTS

| | | | | |
|---|---|---|---|---|
| JP | 2013-238842 | A | 11/2013 | |
| JP | 2015-84013 | A | 4/2015 | |
| JP | 2017-156441 | A | 9/2017 | |
| JP | 2018-45045 | A | 3/2018 | |
| WO | WO-2017154468 | A1 * | 9/2017 | G03G 15/0865 |

OTHER PUBLICATIONS

Machine translation of Takeuchi, JP 2005-062606 (2005).*

International Search Report and Written Opinion with English translation of International Search Report issued in PCT/2019/002435, dated Apr. 9, 2019.

International Preliminary Report on Patentability issued in corresponding International Patent Application No. PCT/JP2019/002435, dated Oct. 6, 2020.

* cited by examiner

IMAGE FORMING APPARATUS HAVING SENSOR TO DETECT WHETHER DEVELOPING ROLLER IS AT SEPARATION POSITION

CROSS REFERENCE TO RELATED APPLICATION

This application is a by-pass continuation application of International Application No. PCT/JP2019/002435 filed Jan. 25, 2019 claiming priority from Japanese Patent Application No. 2018-068149 filed Mar. 30, 2018. The entire contents of the international application and the priority application are incorporated herein by reference.

TECHNICAL FIELD

The present disclosure relates to an image forming apparatus.

BACKGROUND

A conventional image forming apparatus includes photosensitive drums, developing rollers, and a separation mechanism. The separation mechanism moves the developing rollers from respective contact positions to respective separation positions. At the contact positions, the surfaces of the developing rollers are in contact with the surfaces of the respective photosensitive drums. At the separation positions, the surfaces of the developing rollers are separated from the surfaces of the respective photosensitive drums.

SUMMARY

However, the conventional image forming apparatus cannot recognize whether or not the separation mechanism actually operates. In a case where the developing roller is supposed to be positioned at the separation position, a developing roller may be positioned at the contact position, and the developing roller may unintentionally contact the corresponding photosensitive drum.

In view of the foregoing, it is an object of the present disclosure to provide an image forming apparatus capable of reducing wearing of a developing roller and a photosensitive drum even in a case where the developing roller unintentionally contacts the photosensitive drum.

In order to attain the above and other objects, the disclosure provides an image forming apparatus. The image forming apparatus includes a photosensitive drum, a developing roller, a separation mechanism, a motor, a sensor, and a controller. The separation mechanism is configured to move the developing roller from a contact position to a separation position. At the contact position a surface of the developing roller is in contact with a surface of the photosensitive drum. At the separation position the surface of the developing roller is separated from the surface of the photosensitive drum. The motor is configured to cause the separation mechanism to operate. The sensor is configured to detect whether the developing roller is at the separation position. The controller is electrically connected to the sensor and the motor and configured to execute: a transmission process transmitting to the motor a command to drive the separation mechanism; a determination process determining whether or not the sensor detects that the developing roller is positioned at the separation position within a predetermined period of time after the command is transmitted in the transmission process; and a stop process stopping image formation operation in a case where the sensor does not detect that the developing roller is positioned at the separation position.

According to another aspect, the disclosure provides an image forming apparatus. The image forming apparatus includes a photosensitive drum, a developing roller, a separation mechanism, a motor, a sensor, and a controller. The separation mechanism configured to move the developing roller from a contact position to a separation position. At the contact position a surface of the developing roller is in contact with a surface of the photosensitive drum. At the separation position the surface of the developing roller is separated from the surface of the photosensitive drum. The motor is configured to cause the separation mechanism to operate. The sensor is configured to detect whether the developing roller is at the separation position. The controller is electrically connected to the sensor and the motor and configured to execute: a transmission process transmitting to the motor a command to drive the separation mechanism; a determination process determining whether or not the sensor detects that the developing roller is positioned at the separation position within a predetermined period of time after the command is transmitted in the transmission process; and a print process executing image formation operation in a state where a predetermined image formation function is limited in a case where the sensor does not detect that the developing roller is positioned at the separation position.

BRIEF DESCRIPTION OF THE DRAWINGS

The particular features and advantages of the disclosure as well as other objects will become apparent from the following description taken in connection with the accompanying drawings, in which.

DETAILED DESCRIPTION

1. Overview of Image Forming Apparatus 1

Figure 1:
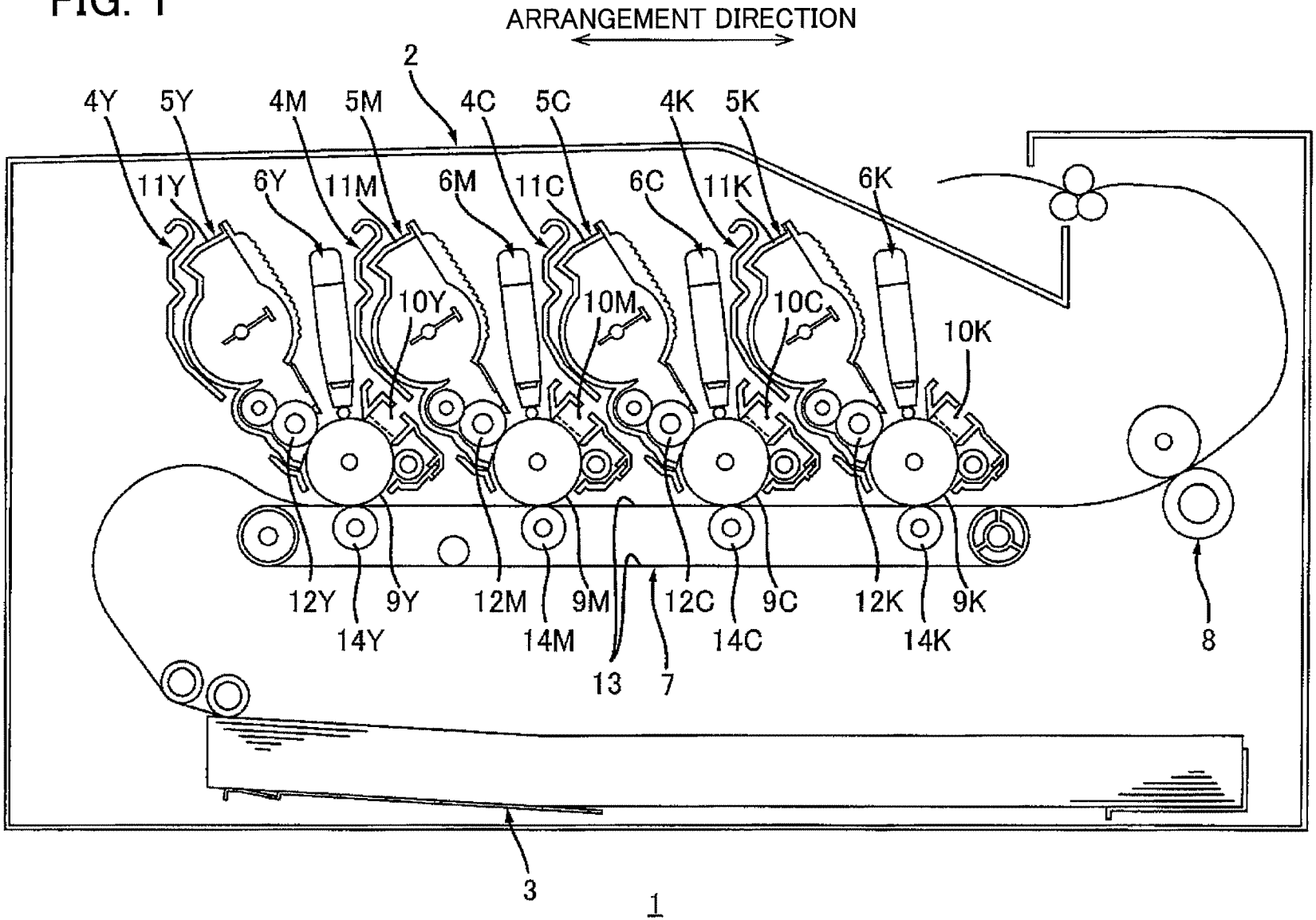
FIG. 1 is a schematic configuration diagram illustrating an image forming apparatus.

The overview of an image forming apparatus 1 will be described with reference to FIG. 1.

The image forming apparatus 1 includes a main-body casing 2, a sheet feed tray 3, a plurality of frames 4Y, 4M, 4C, and 4K, a plurality of developing cartridges 5Y, 5M, 5C, and 5K, a plurality of exposure devices 6Y, 6M, 6C, and 6K, a transfer device 7, and a fixing device 8.

1.1. Main-Body Casing 2

The main-body casing 2 constitutes the exterior of the image forming apparatus 1. The main-body casing 2 accommodates the sheet feed tray 3, the plurality of frames 4Y, 4M, 4C, and 4K, the plurality of developing cartridges 5Y, 5M, 5C, and 5K, the plurality of exposure devices 6Y, 6M, 6C, and 6K, the transfer device 7, and the fixing device 8.

1.2 Sheet Feed Tray 3

The sheet feed tray 3 accommodates printing media such as printing sheets. The sheet feed tray 3 is detachably attachable to the main-body casing 2.

1.3 Plurality of Frames 4Y, 4M, 4C, and 4K

Each of the plurality of frames 4Y, 4M, 4C, and 4K is detachably attachable to the image forming apparatus 1 and is a drum cartridge. The developing cartridge 5Y is detachably attachable to the frame 4Y. Specifically, in a state where the developing cartridge 5Y is attached to the frame 4Y, the frame 4Y is detachably attachable to the image forming apparatus 1. The developing cartridge 5M is detachably attachable to the frame 4M. Specifically, in a state where the developing cartridge 5M is attached to the frame 4M, the frame 4M is detachably attachable to the image forming apparatus 1. The developing cartridge 5C is detachably attachable to the frame 4C. Specifically, in a state where the developing cartridge 5C is attached to the frame 4C, the frame 4C is detachably attachable to the image forming apparatus 1. The developing cartridge 5K is detachably attachable to the frame 4K. Specifically, in a state where the developing cartridge 5K is attached to the frame 4K, the frame 4K is detachably attachable to the image forming apparatus 1. Instead of the plurality of frames 4Y, 4M, 4C, and 4K, the image forming apparatus 1 may include a single drawer to which the plurality of developing cartridges 5Y, 5M, 5C, and 5K is attachable. The drawer is movable between an inside position positioned in the main-body casing 2 and an outside position positioned outside of the main-body casing 2. The frame 4Y includes a photosensitive drum 9Y and a charger 10Y. The frame 4M includes a photosensitive drum 9M and a charger 10M. The frame 4C includes a photosensitive drum 9C and a charger 10C. The frame 4K includes a photosensitive drum 9K and a charger 10K. That is, the image forming apparatus 1 includes the plurality of photosensitive drums 9Y, 9M, 9C, and 9K and the plurality of chargers 10Y, 10M, 10C, and 10K.

In a state where the plurality of frames 4Y, 4M, 4C, and 4K is attached to the image forming apparatus 1, the plurality of photosensitive drums 9Y, 9M, 9C, and 9K is arranged at relative intervals in an arrangement direction. The photosensitive drum 9Y is rotatable about a drum axis extending in an axial direction. The axial direction crosses the arrangement direction. Preferably, the axial direction is perpendicular to the arrangement direction. The photosensitive drum 9Y extends in the axial direction and has a cylindrical shape. The structures of the photosensitive drums 9M, 9C, and 9K are the same as that of the photosensitive drum 9Y, and thus can be described similarly. Therefore, description for the structures of the photosensitive drums 9M, 9C, and 9K is omitted.

Each of the plurality of chargers 10Y, 10M, 10C, and 10K is a scorotron charger. The charger 10Y charges the surface of the photosensitive drum 9Y. The charger 10M charges the surface of the photosensitive drum 9M. The charger 10C charges the surface of the photosensitive drum 9C. The charger 10K charges the surface of the photosensitive drum 9K.

1.4 Plurality of Developing Cartridges 5Y, 5M, 5C, and 5K

The developing cartridge 5Y accommodates toner and is attachable to the frame 4Y. The developing cartridge 5Y includes a developing housing 11Y and a developing roller 12Y. That is, the image forming apparatus 1 includes the developing roller 12Y.

The developing housing 11Y can accommodate toner. The developing housing 11Y extends in the axial direction and has a rectangular cylindrical shape.

In a state where the frame 4Y having the developing cartridge 5Y attached thereto is attached to the image forming apparatus 1, the developing roller 12Y can supply toner to the surface of the photosensitive drum 9Y. The developing roller 12Y is rotatable about a developing roller axis extending in the axial direction. In a state where the developing cartridge 5Y is attached to the frame 4Y, the developing roller 12Y is positioned separated from the charger 10Y in the arrangement direction. In a state where the developing cartridge 5Y is attached to the frame 4Y, the developing roller 12Y is in contact with the photosensitive drum 9Y.

The developing cartridges 5M, 5C, and 5K can be described in a similar way to the developing cartridge 5Y. Thus, description of each of the developing cartridges 5M, 5C, and 5K is omitted.

1.5 Plurality of Exposure Devices 6Y, 6M, 6C, and 6K

The exposure device 6Y exposes the surface of the photosensitive drum 9Y. In a case where the surface of the photosensitive drum 9Y is charged by the charger 10Y, a latent image is formed on the surface of the photosensitive drum 9Y by exposing the charged surface of the photosensitive drum 9Y by the exposure device 6Y. A toner image is formed on the surface of the photosensitive drum 9Y by supplying toner with the latent image formed on the surface of the photosensitive drum 9Y by the developing roller 12Y. The exposure device 6Y includes a light-emitting diode (LED) array. The exposure devices 6M, 6C, and 6K can be described in a similar way to the exposure device 6Y. Thus, description of exposure devices 6M, 6C, and 6K is omitted.

Instead of the plurality of exposure devices 6Y, 6M, 6C, and 6K, the image forming apparatus 1 may include a single exposure device that is configured to expose the plurality of photosensitive drums 9Y, 9M, 9C, and 9K. In this case, the single exposure device may be a laser scan unit.

1.6 Transfer Device 7

The transfer device 7 conveys in the arrangement direction a printing medium which is conveyed from the sheet feed tray 3, and transfers a toner image of each of the plurality of photosensitive drums 9Y, 9M, 9C, and 9K onto the printing medium. The transfer device 7 includes a conveying belt 13 and a plurality of transfer rollers 14Y, 14M, 14C, and 14K.

The conveying belt 13 conveys in the arrangement direction the printing medium which is conveyed from the sheet feed tray 3.

The transfer roller 14Y transfers the toner image of the photosensitive drum 9Y onto the printing medium. Each of the transfer rollers 14M, 14C, and 14K can be described in a similar manner to the transfer roller 14Y and thus description of the transfer rollers 14M, 14C, and 14K is omitted.

1.7 Fixing Device 8

The fixing device 8 thermally fixes a toner image onto the printing medium.

2. Details of Image Forming Apparatus 1

The image forming apparatus 1 will be described in detail with reference to FIGS. 2 and 3.

The image forming apparatus 1 includes a separation mechanism 21, a motor 22, a plurality of levers 23Y, 23M, 23C, and 23K, a plurality of sensors 24Y, 24M, 24C, and 24K, and a controller 25.

2.1 Separation Mechanism 21

The separation mechanism 21 moves each of the developing rollers 12Y, 12M, 12C, and 12K from a corresponding contact position to a corresponding separation position.

Figure 2:
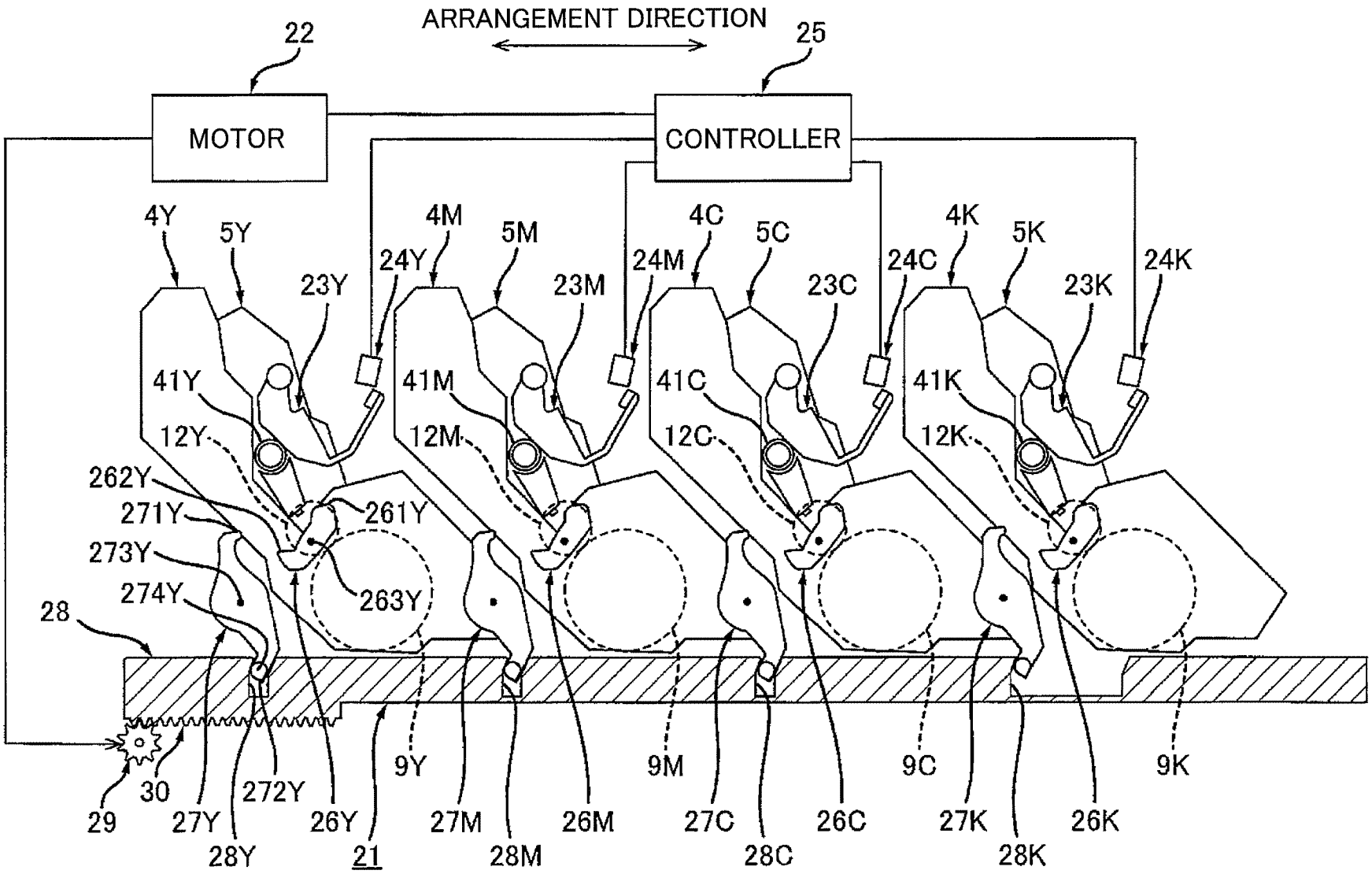
FIG. 2 is an explanatory diagram illustrating a state where all developing rollers are positioned at respective separation positions in a case where the image forming apparatus shown in FIG. 1 performs multicolor printing.
Figure 3:
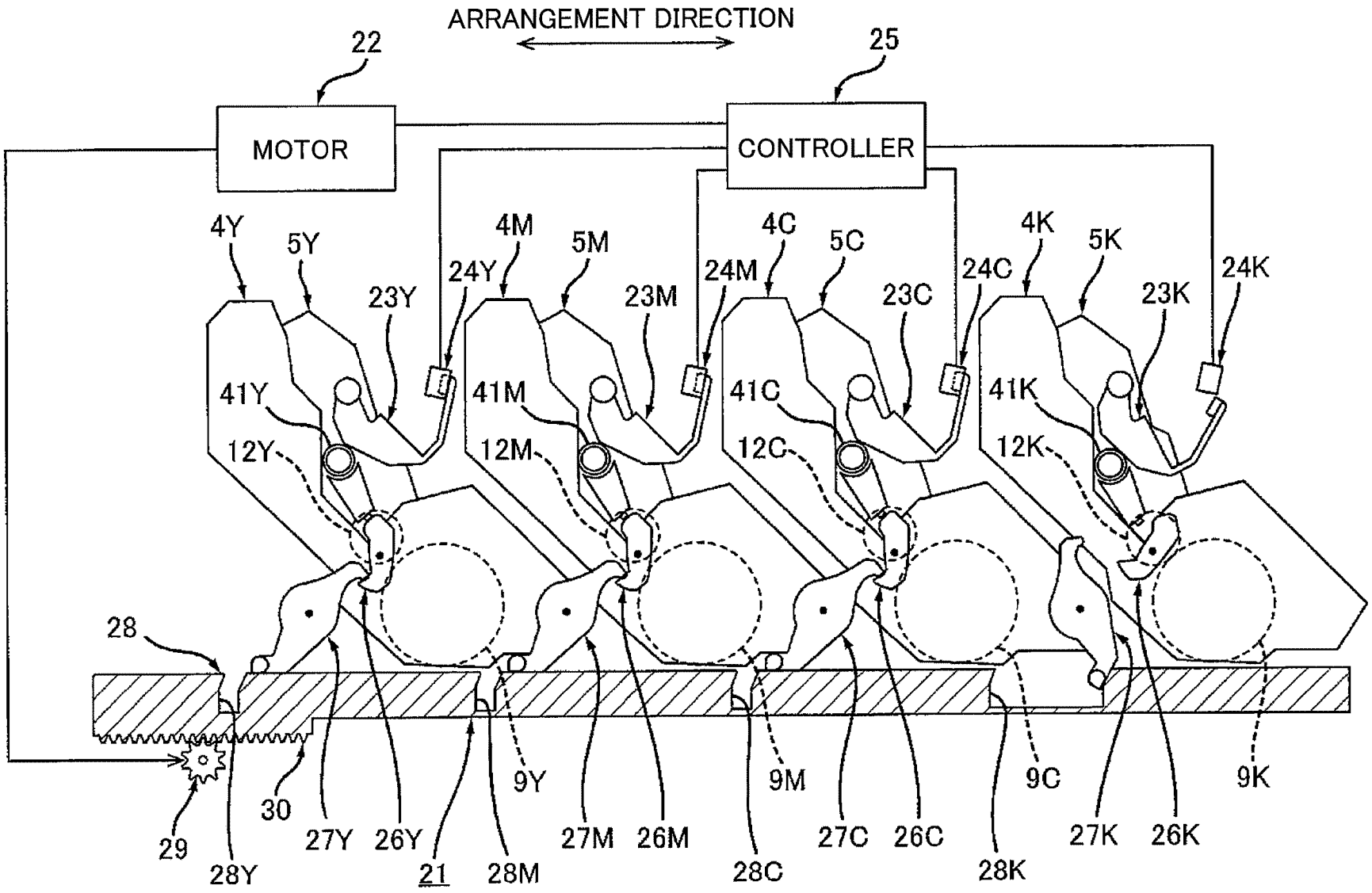
FIG. 3 is an explanatory diagram illustrating a state where only the developing roller K is positioned at a contact position in a case where the image forming apparatus shown in FIG. 1 performs monochrome printing.

Specifically, in a case where the image forming apparatus 1 switches from multicolor (color) printing to monochrome printing, the separation mechanism 21 moves developing rollers, which are not used for monochrome printing, from the respective contact positions (see FIG. 2) to the respective separation positions (see FIG. 3).

As illustrated in FIG. 2, in a case where the image forming apparatus 1 performs multicolor (color) printing, all the developing rollers 12Y, 12M, 12C, and 12K are positioned at the respective contact positions. In a case where the developing roller 12Y is at the contact position, the surface of the developing roller 12Y is in contact with the surface of the photosensitive drum 9Y. In a case where the developing roller 12M is at the contact position, the surface of the developing roller 12M is in contact with the surface of the photosensitive drum 9M. In a case where the developing roller 12C is at the contact position, the surface of the developing roller 12C is in contact with the surface of the photosensitive drum 9C. In a case where the developing roller 12K is at the contact position, the surface of the developing roller 12K is in contact with the surface of the photosensitive drum 9K.

As illustrated in FIG. 3, in a case where the image forming apparatus 1 performs monochrome printing, the developing rollers 12Y, 12M, and 12C are positioned at the respective separation positions and the developing roller 12K is positioned at the contact position. In a case where the developing roller 12Y is at the separation position, the surface of the developing roller 12Y is separated from the surface of the photosensitive drum 9Y. In a case where the developing roller 12M is at the separation position, the surface of the developing roller 12M is separated from the surface of the photosensitive drum 9M. In a case where the developing roller 12C is at the separation position, the surface of the developing roller 12C is separated from the surface of the photosensitive drum 9C.

Specifically, the separation mechanism 21 moves the developing cartridge 5Y relative to the photosensitive drum 9Y between a first position (see FIG. 2) and a second position (FIG. 3). In a case where the developing cartridge 5Y is at the first position, the developing roller 12Y is at the contact position. In a case where the developing cartridge 5Y is at the second position, the developing roller 12Y is at the separation position. Further, the separation mechanism 21 moves the developing cartridge 5M relative to the photosensitive drum 9M between a first position (see FIG. 2) and a second position (FIG. 3). In a case where the developing cartridge 5M is at the first position, the developing roller 12M is at the contact position. In a case where the developing cartridge 5M is at the second position, the developing roller 12M is at the separation position. Further, the separation mechanism 21 moves the developing cartridge 5C relative to the photosensitive drum 9C between a first position (see FIG. 2) and a second position (FIG. 3). In a case where the developing cartridge 5C is at the first position, the developing roller 12C is at the contact position. In a case where the developing cartridge 5C is at the second position, the developing roller 12C is at the separation position.

Figure 4:
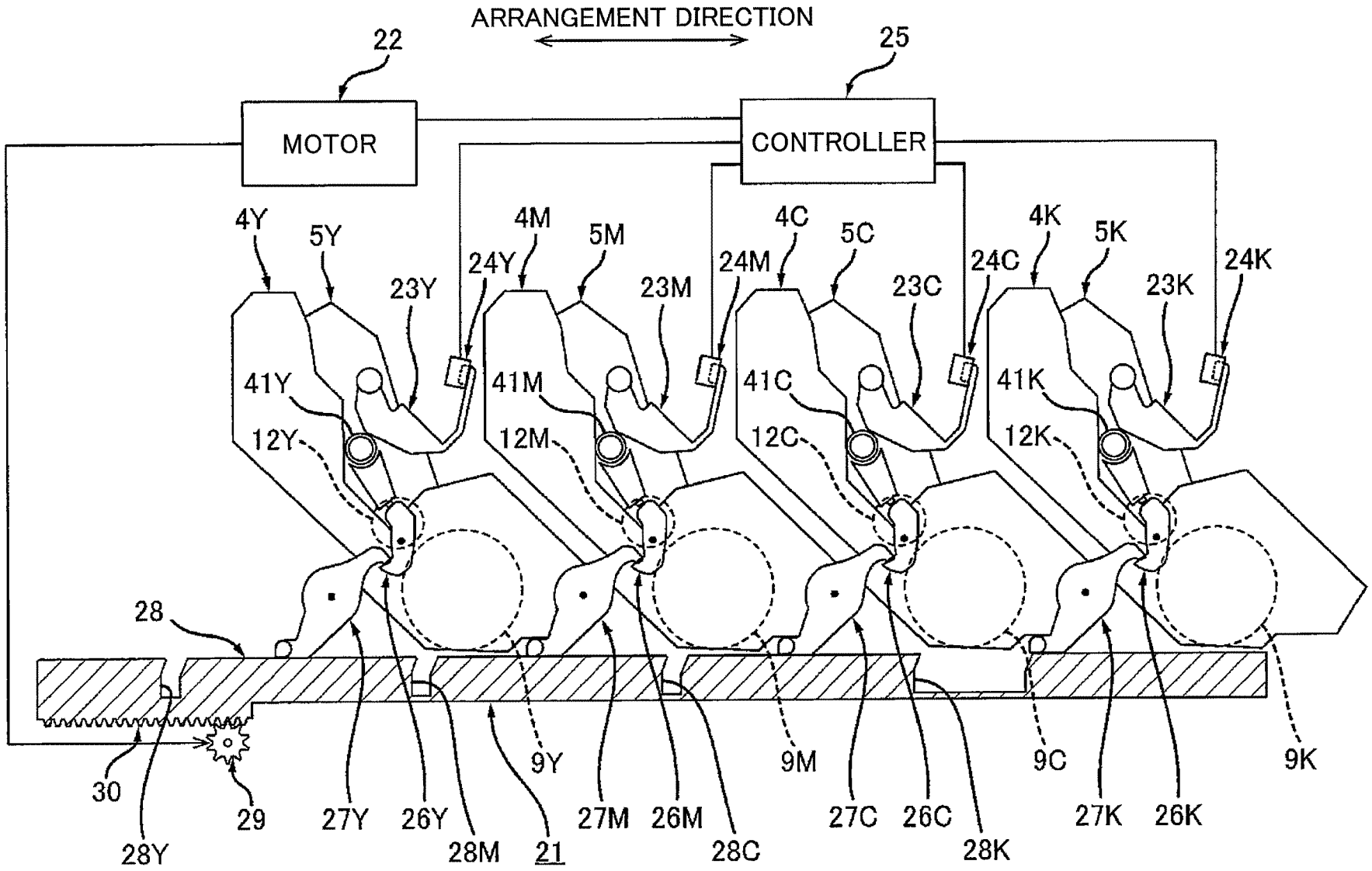
FIG. 4 is an explanatory diagram illustrating a state where all the developing rollers are positioned at respective contact positions in a case where the image forming apparatus shown in FIG. 1 does not perform printing.

As illustrated in FIG. 4, the separation mechanism 21 moves all the developing rollers 12Y, 12M, 12C, and 12K to the respective separation positions from the respective contact positions. In a case where the developing roller 12K is positioned at the separation position, the surface of the developing roller 12K is separated from the surface of the photosensitive drum 9K. The separation mechanism 21 moves the developing cartridge 5K relative to the photosensitive drum 9K between a first position (see FIG. 3) and a second position (see FIG. 4). In a case where the developing cartridge 5K is at the first position (see FIG. 3), the developing roller 12K is at the contact position. In a case where the developing cartridge 5K is at the second position (see FIG. 4), the developing roller 12K is at the separation position.

As illustrated in FIG. 2, the separation mechanism 21 includes a plurality of separation levers 26Y, 26M, 26C, and 26K, a plurality of main-body levers 27Y, 27M, 27C, and 27K, a linear motion cam 28, and a pinion gear 29.

2.1.1 Plurality of Separation Levers 26Y, 26M, 26C, and 26K

The separation lever 26Y is attached to a side surface of the frame 4Y in the axial direction. The separation lever 26M is attached to a side surface of the frame 4M in the axial direction. The separation lever 26C is attached to a side surface of the frame 4C in the axial direction. The separation lever 26K is attached to a side surface of the frame 4K in the axial direction.

The structures of the separation levers 26Y, 26M, 26C, and 26K are the same. Therefore, the following description will focus on the structure of the separation lever 26Y and omit the description of the structures of the separation levers 26M, 26C, and 26K.

The separation lever 26Y includes one end portion 261Y, another end portion 262Y, and a rotational axis 263Y. The another end portion 262Y is positioned separated from the one end portion 261Y. The rotational axis 263Y is positioned between the one end portion 261Y and the another end portion 262Y.

The separation lever 26Y is pivotally movable between a first pressing position (see FIG. 3) and a first pressing release position (see FIG. 2) about the rotational axis 263Y.

Specifically, pressing the another end portion 262Y by the main-body lever 27Y causes the separation lever 26Y pivotally to move from the first pressing release position to the first pressing position. The main-body lever 27Y will be described in detail later. In a case where the separation lever 26Y pivotally moves from the first pressing release position to the first pressing position, the one end portion 261Y presses a part of the developing cartridge 5Y. Pressing the part of the developing cartridge 5Y by the one end portion 261Y causes the developing cartridge 5Y to move from the first position to the second position.

On the other hand, separation of the main-body lever 27Y from the another end portion 262Y cause the separation lever 26Y to pivotally move from the first pressing position to the first pressing release position. In a case where the separation lever 26Y pivotally moves from the first pressing position to the first pressing release position, the one end portion 261Y stops pressing the developing cartridge 5Y. Stopping pressing the developing cartridge 5Y by the one end portion 261Y causes the developing cartridge 5Y to move from the second position to the first position.

2.1.2 Plurality of Main-Body Levers 27Y, 27M, 27C, and 27K

The plurality of main-body levers 27Y, 27M, 27C, and 27K is provided inside the main-body casing 2. The plurality of main-body levers 27Y, 27M, 27C, and 27K are arranged at relative intervals in the arrangement direction.

The structures of the main-body levers 27Y, 27M, 27C, and 27K are the same. Therefore, the following description will focus on the structure of the main-body lever 27Y and omit the description of the main-body levers 27M, 27C, and 27K.

The main-body lever 27Y includes one end portion 271Y, another end portion 272Y, a pivot axis 273Y, and a protrusion 274Y. The another end portion 272Y is positioned separated from the one end portion 271Y. The pivot axis 273Y is positioned between the one end portion 271Y and the another end portion 272Y. The protrusion 274Y protrudes from the another end portion 272Y in a first direction.

The main-body lever 27Y is pivotally movable between a second pressing position (see FIG. 3) and a second pressing release position (see FIG. 2) about the pivot axis 273Y. Specifically, pressing the another end portion 272Y by the linear motion cam 28 causes the main-body lever 27Y to pivotally move between the second pressing release position and the second pressing position. The linear motion cam 28 will be described in detail later.

In a case where the main-body lever 27Y pivotally moves from the second pressing release position to the second pressing position, the one end portion 271Y presses the another end portion 262Y of the separation lever 26Y. Pressing the another end portion 262Y of the separation lever 26Y by the one end portion 271Y causes the separation lever 26Y to move from the first pressing release position to the first pressing position.

In a case where the main-body lever 27Y moves from the second pressing position to the second pressing release position, the one end portion 271Y stops pressing the another end portion 262Y of the separation lever 26Y. Stopping pressing the another end portion 262Y of the separation lever 26Y by the one end portion 271Y causes the separation lever 26Y to move from the first pressing position to the first pressing release position.

2.1.3 Linear Motion Cam 28

The linear motion cam 28 moves each of the plurality of main-body levers 27Y, 27M, 27C, and 27K between the second pressing position and the second pressing release position. The linear motion cam 28 is movable in the arrangement direction. Specifically, the linear motion cam 28 is movable between a first position (see FIG. 2) and a second position (see FIG. 3) in the arrangement direction and between the second position and a third position (see FIG. 4) in the arrangement direction.

In a case where the linear motion cam 28 is positioned at the first position, each of the main-body levers 27Y, 27M, 27C, and 27K is positioned at the second pressing release position and each of the separation levers 26Y, 26M, 26C, and 26K is positioned at the first pressing release position. Accordingly, each of the developing rollers 12Y, 12M, 12C, and 12K is positioned at the contact position. In this state, the image forming apparatus 1 can perform multicolor printing using all the developing rollers 12Y, 12M, 12C, and 12K.

In a case where the linear motion cam 28 is positioned at the second position, each of the main-body levers 27Y, 27M, and 27C is positioned at the second pressing position and each of the separation levers 26Y, 26M, and 26C is positioned at the first pressing position. Accordingly, each of the developing rollers 12Y, 12M, and 12C is positioned at the separation position. On the other hand, in the case where the linear motion cam 28 is positioned at the second position, the main-body lever 27K is positioned at the second pressing release position and the separation lever 26K is positioned at the first pressing release position. Accordingly, the developing roller 12K is positioned at the contact position. Thus, the image forming apparatus 1 can perform monochrome printing that does not use the developing rollers 12Y, 12M, and 12C.

In a case where the linear motion cam 28 is positioned at the third position, each of the main-body levers 27Y, 27M, 27C, and 27K is positioned at the second pressing position and each of the separation levers 26Y, 26M, 26C, and 26K is positioned at the first pressing position. Accordingly, each of the developing rollers 12Y, 12M, 12C, and 12K is positioned at the separation position.

The linear motion cam 28 extends in the arrangement direction. The linear motion cam 28 has a first surface S1 and a second surface S2 in a direction crossing the arrangement direction. The first surface S1 is closer to the plurality of developing cartridges 5Y, 5M, 5C, and 5K than the second surface S2 is. The linear motion cam 28 has a rack gear 30 and a plurality of grooves 28Y, 28M, 28C, and 28K.

The rack gear 30 is positioned at an end portion of the linear motion cam 28 in the arrangement direction. The rack gear 30 extends in the arrangement direction.

The plurality of grooves 28Y, 28M, 28C, and 28K is arranged at relative intervals in the arrangement direction and recessed from the first surface S1 toward the second surface S2. In a case where the main-body lever 27Y is positioned at the second pressing release position, the protrusion 274Y is inserted in the groove 28Y.

By movement of the linear motion cam 28 from the first position toward the second position in a state where the protrusion 274Y is inserted in the groove 28Y, the main-body lever 27Y pivotally moves from the second pressing release position toward the second pressing position about the pivot axis 273Y. Before the linear motion cam 28 reaches the second position, the protrusion 274Y moves out of the groove 28Y and contacts the first surface S1. In a case where the protrusion 274Y contacts the first surface S1, the main-body lever 27Y is positioned at the second pressing position.

In a case where the protrusion 274Y contacts the first surface S1 and the linear motion cam 28 moves toward the first position from the second position, the protrusion 274Y is inserted in the groove 28Y before the linear motion cam 28 is positioned at the first position. In a state where the protrusion 274Y is inserted in the groove 28Y, movement of the linear motion cam 28 further toward the first position causes the main-body lever 27Y to pivotally move from the second pressing position toward the second pressing release position about the pivot axis 273Y. In a state where the linear motion cam 28 is positioned at the first position and the protrusion 274Y is inserted in the groove 28Y, the main-body lever 27Y is positioned at the second pressing release position.

In a case where the main-body lever 27M is positioned at the second pressing release position, a protrusion 274M of the main-body lever 27M is inserted in the groove 28M. In a case where the main-body lever 27C is positioned at the second pressing release position, a protrusion 274C of the main-body lever 27C is inserted in the groove 28C.

In a case where the main-body lever 27K is positioned at the second pressing release position, a protrusion 274K of the main-body lever 27K is inserted in the groove 28K. The length of the groove 28K in the arrangement direction is greater than the length of any of the grooves 28Y, 28M, and 28C in the arrangement direction. Thus, the main-body lever 27K is inserted in the groove 28K even in a state where the linear motion cam 28 is positioned at the second position (see FIG. 3). Accordingly, in a state where the linear motion cam 28 is at the second position, the main-body lever 27K is not at the second pressing position. Specifically, the main-body lever 27K stops in the middle of its pivotal movement from the second pressing release position to the second pressing position and is positioned separated from the separation lever 26K. Accordingly, in a state where the linear motion cam 28 is positioned at the second position, the developing rollers 12Y, 12M, and 12C are positioned at the respective separation positions, and the developing roller 12K is positioned at the contact position.

In a state where the linear motion cam 28 is positioned at the third position (see FIG. 4), the main-body lever 27K is released from a state inserted in the groove 28K, and is positioned at the second pressing position. Therefore, in a state where the linear motion cam 28 is positioned at the third position, all the developing rollers 12Y, 12M, 12C, and 12K are positioned at the respective separation positions.

2.1.4 Pinion Gear 29

The pinion gear 29 meshingly engages with the rack gear 30. By receiving power from the motor 22, the pinion gear 29 rotates. Accordingly, the linear motion cam 28 can move in the arrangement direction.

2.2 Motor 22

The motor 22 causes the separation mechanism 21 to operate. The motor 22 is coupled to the pinion gear 29 via a gear train, not illustrated. The power of the motor 22 is transmitted to the pinion gear 29 via the gear train (not illustrated).

2.3 Plurality of Levers 23Y, 23M, 23C, and 23K

As illustrated in FIG. 2, in a state where the frame 4Y having the developing cartridge 5Y attached thereto is attached to the image forming apparatus 1, the lever 23Y is in contact with a part of the developing cartridge 5Y. In a case where the developing roller 12Y moves from the contact position (see FIG. 2) to the separation position (see FIG. 3), the lever 23Y in contact with the part of the developing cartridge 5Y is movable from a non-detection position (see FIG. 2) to a detection position (see FIG. 3). Specifically, the part of the developing cartridge 5Y is a developing electrode 41Y. That is, the developing cartridge 5Y includes the developing electrode 41Y.

In a state where the frame 4Y having the developing cartridge 5Y attached thereto is attached to the image forming apparatus 1, the developing electrode 41Y receives electric power from the image forming apparatus 1. The developing electrode 41Y is electrically connected to the developing roller 12Y. The developing electrode 41Y extends in the axial direction. The developing electrode 41Y is positioned at the outer surface of the developing housing 11Y in the axial direction. The lever 23Y may include a main-body electrode for supplying electric power to the developing electrode 41Y. The main-body electrode may be a member different from the lever 23Y.

The levers 23M, 23C, and 23K can be described in a similar way to the lever 23Y and description thereof is omitted.

2.4 Plurality of Sensors 24Y, 24M, 24C, and 24K

The sensor 24Y detects whether the developing roller 12Y is at the separation position. In a case where the lever 23Y is at the non-detection position (see FIG. 2), the sensor 24Y does not detect the lever 23Y. In a case where the lever 23Y is at the detection position (see FIG. 3), the sensor 24Y detects the lever 23Y. The sensor 24Y is, for example, a photosensor including a light emitter and a light receiver.

The light receiver is positioned separated from the light emitter and receives light from the light emitter. In a case where the sensor 24Y is a photosensor, the lever 23Y at the non-detection position is not positioned between the light emitter and the light receiver and does not block light from the light emitter. Therefore, the sensor 24Y does not detect the lever 23Y. In a case where the lever 23Y is at the detection position, the lever 23Y is positioned between the light emitter and the light receiver and blocks the light from the light emitter. Therefore, the sensor 24Y detects the lever 23Y. By detecting the lever 23Y, the sensor 24Y detects that the developing roller 12Y is at the separation position.

The sensors 24M, 24C, and 24K can be described in a similar way to the sensor 24Y and description thereof is omitted.

2.5 Controller 25

The controller 25 is electrically connected to the plurality of sensors 24Y, 24M, 24C, and 24K and the motor 22. Accordingly, the controller 25 can determine, by receiving electric signal from the sensor 24Y, whether or not the sensor 24Y detects the lever 23Y. The controller 25 can also determine, by receiving electric signal from the sensor 24M, whether or not the sensor 24M detects the lever 23M. The controller 25 can also determine, by receiving electric signal from the sensor 24C, whether or not the sensor 24C detects the lever 23C. The controller 25 can determine, by receiving electric signal from the sensor 24K, whether or not the sensor 24K detects the lever 23K. The controller 25 can switch between on and off of the motor 22. The controller 25 includes, for example, a circuit board having an application-specific integrated circuit (ASIC) mounted thereon or a circuit board having a central processing unit (CPU) mounted thereon.

3. Operation of Image Forming Apparatus 1

The operation of the image forming apparatus 1 will be described with reference to FIGS. 2 to 5.

Figure 5:
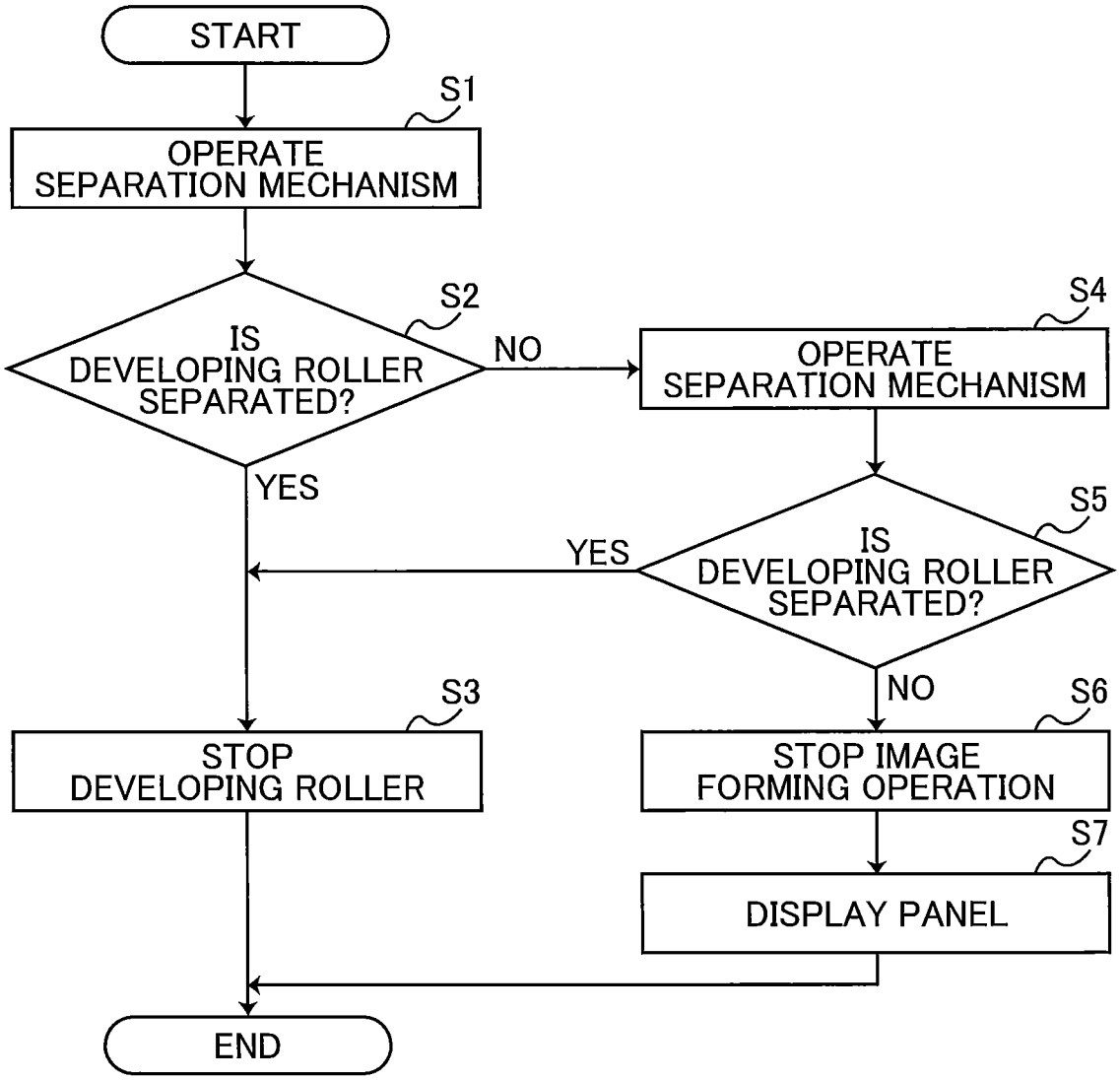
FIG. 5 is a flowchart executed by a controller.

In a case where the controller 25 causes each of the plurality of developing rollers 12Y, 12M, 12C, and 12K to move from the contact position to the separation position, specifically in a case where the controller 25 causes the image forming apparatus 1 to switch printing operation from multicolor printing to monochrome printing, the controller 25 performs a transmission process (S1), a determination process (S2), a retransmission process (S4), a re-determination process (S5), and a stop process (S6) as illustrated in FIG. 5.

3.1 Transmission Process (S1)

In the transmission process (S1), the controller 25 transmits a command to the motor 22 to cause the motor 22 to operate the separation mechanism 21. Specifically, in the transmission process (S1), the controller 25 transmits the command to the motor 22 to cause the motor 22 to drive so that the linear motion cam 28 moves from the first position (see FIG. 2) to the second position (see FIG. 3). Accordingly, the linear motion cam 28 moves from the first position to the second position, each of the plurality of developing rollers 12Y, 12M, and 12C moves from the contact position to the separation position.

In the transmission process (S1), the controller 25 may transmit a command that causes the linear motion cam 28 to move from the second position to the third position. In this case, the linear motion cam 28 moves from the second position to the third position, and the developing roller 12K moves from the contact position to the separation position.

Alternatively, in the transmission process (S1), the controller 25 may transmit a command that causes the linear motion cam 28 to move from the first position to the second position and further from the second position to the third position. In this case, the linear motion cam 28 moves from the first position to the second position and from the second position to the third position, and each of the plurality of developing rollers 12Y, 12M, 12C, and 12K moves from the contact position to the separation position.

In some cases, a developing roller may be positioned at the contact position though the developing roller is supposed to be positioned at the separation position. In this case, assuming that the image forming operation continues in a state where the developing roller is unintentionally in contact with its corresponding photosensitive drum, the developing roller and the photosensitive drum may be worn out.

In the present embodiment, in a case where the linear motion cam 28 moves from the first position to the second position: according to the determination process (S2), the retransmission process (S4), and the re-determination process (S5), the controller 25 determines whether or not each of the plurality of developing rollers 12Y, 12M, and 12C is positioned at the separation position, and in a case where at least one of the developing rollers 12Y, 12M, and 12C is not positioned at the separation position (S5: NO), the controller 25 stops the image forming operation by performing performs the stop process (S6).

In a case where the linear motion cam 28 moves to the third position from the second position: according to the determination process (S2), the retransmission process (S4), and the re-determination process (S5), the controller 25 determines whether or not each of the plurality of developing rollers 12Y, 12M, 12C, and 12K is positioned at the separation position, and in a case where at least one of the developing rollers 12Y, 12M, 12C, and 12K is not positioned at the separation position (S5: NO), the controller 25 stops the image forming operation by performing the stop process (S6).

In a case where the linear motion cam 28 moves from the first position to the second position and further from the second position to the third position: according to the determination process (S2), the retransmission process (S4), and the re-determination process (S5), the controller 25 determines whether or not all the plurality of developing rollers 12Y, 12M, 12C, and 12K are positioned at the respective separation positions, and in a case where at least one of the developing rollers 12Y, 12M, 12C, and 12K is not positioned at the separation position (S5: NO), the controller 25 stops the image forming operation by performing the stop process (S6).

Details of the processes in a case where the linear motion cam 28 moves from the first position to the second position will be described below, taking the developing roller 12Y as an example.

3.2 Determination Process (S2)

In the determination process (S2), the controller 25 determines whether or not the sensor 24Y detects that the developing roller 12Y is at the separation position within a predetermined period of time after the command is transmitted to the motor 22 in the transmission process (S1), for example.

In a case where the sensor 24Y detects that the developing roller 12Y is at the separation position (S2: YES), the controller 25 stops the developing roller 12Y by stopping transmitting power to the developing roller 12Y (S3).

On the other hand, in a case where the sensor 24Y does not detect that the developing roller 12Y is at the separation position (S2: NO), the controller 25 performs the retransmission process (S4).

3.3 Retransmission Process (S4)

In the retransmission process (S4), the controller 25 retransmits, to the motor 22, the command that causes the motor 22 to operate the separation mechanism 21. Specifically, similarly to the transmission process (S1), in the retransmission process (S4), transmission of the command too the motor 22 from the controller 25 causes the motor 22 to drive so that the linear motion cam 28 moves from the first position (see FIG. 2) to the second position (see FIG. 3).

3.4 Re-determination Process (S5)

In the re-determination process (S5), the controller 25 determines whether or not the sensor 24Y detects that the developing roller 12Y is at the separation position or not within a predetermined period of time after the command is transmitted to the motor 22 in the retransmission process (S4).

In a case where the sensor 24Y detects that the developing roller 12Y is at the separation position (S5: YES), the controller 25 stops the developing roller 12Y by stopping transmitting power to the developing roller 12Y (S3).

On the other hand, the sensor 24Y detects that the developing roller 12Y is at the separation position (S5: NO), the controller 25 performs the stop process (S6).

3.5 Stop Process (S6)

In a case where the sensor 24Y does not detect that the developing roller 12Y is at the separation position in the determination process (S2: NO) and the sensor 24Y does not detect that the developing roller 12Y is at the separation position in the re-determination process (S5: NO), the controller 25 performs the stop process (S6) to stop the image forming operation. That is, in a case where the image forming apparatus 1 performs monochrome printing and the sensor 24Y does not detect that the developing roller 12Y is at the separation position, the controller 25 stops the image forming operation.

Thereafter, the controller 25 displays an error message on a panel disposed on the outer surface of the main-body casing 2 (S7).

The controller 25 also stops the image forming operation in a case where the separation position cannot be detected for at least one of the sensors 24M and 24C (S2: NO and S5: NO). Thereafter, the controller 25 displays the error message on the panel disposed on the outer surface of the main-body casing 2 (S7).

In a case where the linear motion cam 28 moves to the third position from the second position and at least one of the sensors 24Y, 24M, 24C, and 24K does not detect that the corresponding developing roller 12Y, 12M, 12C, or 12K is at the separation position (S2: NO and S5: NO), the controller 25 stops the image forming operation. Thereafter, the controller 25 displays the error message on the panel disposed on the outer surface of the main-body casing 2 (S7).

In a case where the linear motion cam 28 moves from the first position to the second position and further from the second position to the third position and at least one of the sensors 24Y, 24M, 24C, and 24K does not detect that the corresponding developing roller 12Y, 12M, 12C, or 12K is at the separation position (S2: NO and S5: NO), the controller 25 stops the image forming operation. Thereafter, the controller 25 displays the error message on the panel disposed on the outer surface of the main-body casing 2 (S7).

4. Function and Effects

According to the image forming apparatus 1, as illustrated in FIG. 5, in a case where the developing roller 12Y is supposed to be positioned at the separation position but is actually positioned at the contact position (S5: NO), the controller 25 can stop the image forming operation (S6).

Accordingly, the image forming operation can be prevented from being performed in a state where the developing roller 12Y is unintentionally in contact with the photosensitive drum 9Y.

As a result, the wearing between the developing roller 12Y and the photosensitive drum 9Y can be restrained even in a case where the developing roller 12Y unintentionally contacts the photosensitive drum 9Y.

5. First Modification

A first modification will be described with reference to FIG. 6. In the first modification, members and processes similar to those described in the above-described embodiment will be designated by the same reference signs and will not be described.

Figure 6:
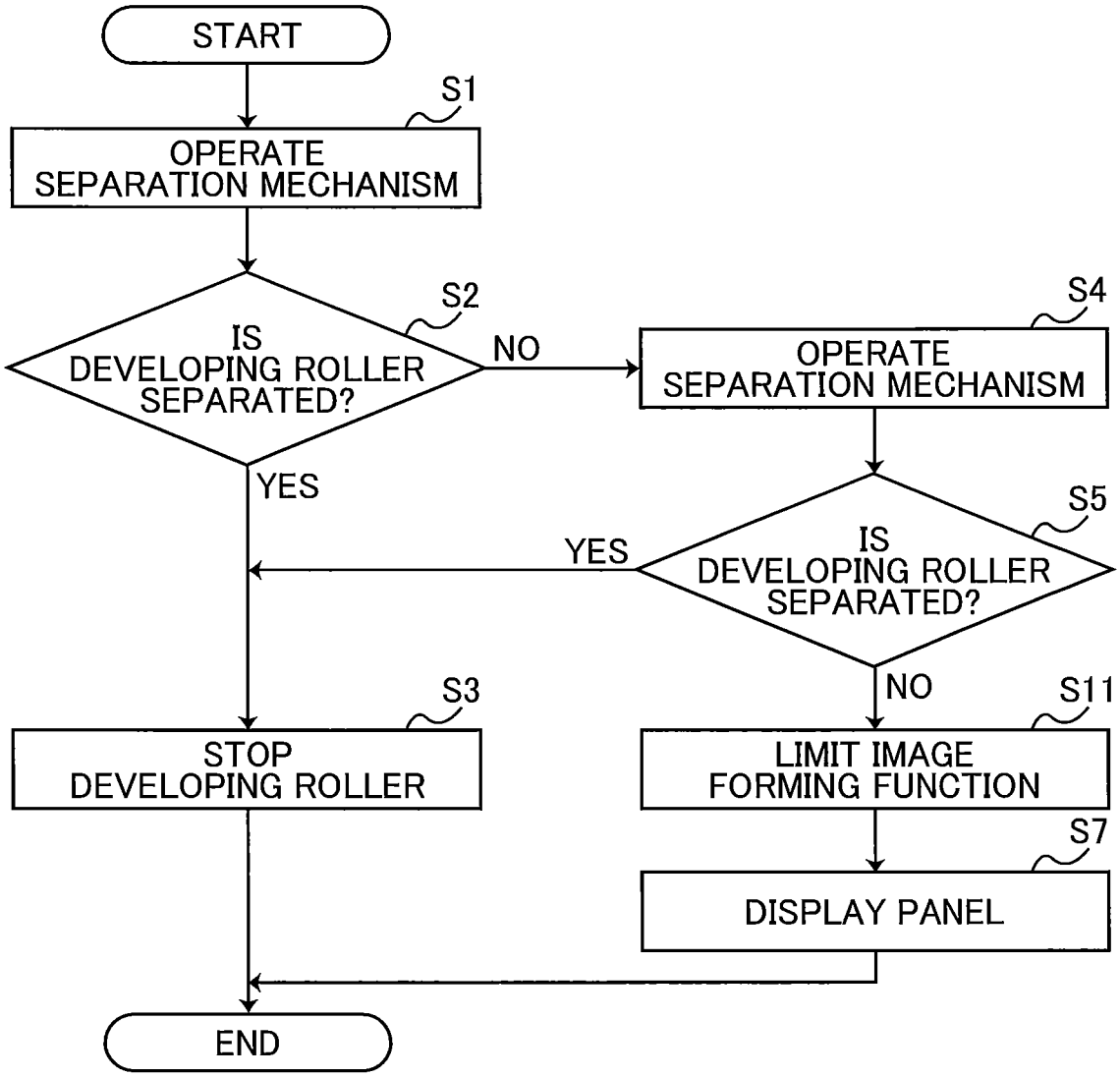
FIG. 6 is a flowchart according to a first modification.

As illustrated in FIG. 6, the controller 25 may perform a printing process (S11), instead of the stop process (S6 of FIG. 5).

In the printing process (S11), the controller 25 performs an image forming operation in a state where a predetermined image forming function is limited. The state where the predetermined image forming function is limited may be, for example, a state where the replacement timing of the developing cartridge 5Y is advanced, a state where the number of printable sheets of the developing cartridge 5Y is reduced, or a state where the rotation speed of the developing roller 12Y is reduced. In this case, the controller 25 may display a message about printing quality on the panel disposed on the outer surface of the main-body casing 2.

In the first modification, the controller 25 limits the predetermined image forming function. This allows the controller 25 to perform an image forming operation in a state where the wearing between the photosensitive drum 9Y and the developing roller 12Y is reduced.

6. Second Modification

In the second modification, the linear motion cam 28 may not move from the second position to the third position. In this case, the separation mechanism 21 may not position the developing roller 12K at the separation position. That is, it is sufficient that the separation mechanism 21 enables the printing operation to be switched at least between multicolor printing (see FIG. 2) and monochrome printing (see FIG. 3).

In this case, in a case where the separation position cannot be detected for at least one of the sensors 24Y, 24M, and 24C (S2: NO and S5: NO), the controller 25 may stop the image forming operation (S6 of FIG. 5) or perform the printing process (S11 of FIG. 6).

7. Other Modifications

In a case where the sensor 24Y does not detect that the developing roller 12Y is at the separation position in the determination process (S2), the controller 25 may skip the retransmission process (S4) and the re-determination process (S5) and perform the stop process (S6).

The controller 25 may not display the error message on the panel provided on the outer surface of the main-body casing 2.

In a case where the developing roller 12Y moves from the contact position to the separation position, the lever 23Y may be movable from the detection position to the non-detection position. In this case, in a case where the lever 23Y is at the non-detection position, the sensor 24Y detects that the developing roller 12Y is at the separation position, and in a case where the lever 23Y is at the detection position, the sensor 24Y detects that the developing roller 12Y is at the contact position.

The sensor 24Y is not limited to the photosensor. For example, the sensor 24Y may detect whether or not the developing roller 12Y is at the separation position by detecting whether or not the developing electrode 41Y is electrically connected to the main-body electrode. Specifically, the image forming apparatus 1 is configured as follows: That is, in a case where the developing cartridge 5Y is positioned at the first position, the developing electrode 41Y and the main-body electrode are electrically connected to each other; and in a case where the developing cartridge 5Y is positioned at the second position, the electrical connection between the developing electrode 41Y and the main-body electrode are canceled. By configuring the image forming apparatus 1 in this manner, the sensor 24Y may detect that the developing roller 12Y is at the separation position in a case where the electrical connection between the developing electrode 41Y and the main-body electrode are canceled.

In a case where each developing cartridge includes an integrated circuit (IC) chip and the sensor 24Y does not detect that the developing roller 12Y is at the separation position in the determination process (S2) or the re-determination process (S5), the controller 25 can write the result of the determination process (S2) or the re-determination process (S5) onto the IC chip.

In the above-described embodiment, the image forming apparatus 1 includes the frame 4Y including the photosensitive drum 9Y and the developing cartridge 5Y attachable to the frame 4Y. Alternatively, the image forming apparatus 1 may include, for example, a process cartridge including the photosensitive drum 9Y and the developing roller 12Y.

What is claimed is:

1. An image forming apparatus comprising:

a photosensitive drum;

a developing roller;

a separation mechanism configured to move the developing roller from a contact position to a separation position, at the contact position a surface of the developing roller being in contact with a surface of the photosensitive drum, at the separation position the surface of the developing roller being separated from the surface of the photosensitive drum;

a lever movable from a non-detection position to a detection position in a case where the developing roller is moved from the contact position to the separation position;

a motor configured to cause the separation mechanism to operate;

a sensor configured to detect whether the developing roller is at the separation position;

a controller electrically connected to the sensor and the motor and configured to execute:

a transmission process transmitting to the motor a command to drive the separation mechanism;

a determination process determining whether or not the sensor detects that the developing roller is positioned at the separation position within a predetermined period of time after the command is transmitted in the transmission process; and a stop process stopping image formation operation in a case where the sensor does not detect that the developing roller is positioned at the separation position, wherein in a case where the lever is positioned at the non-detection position, the sensor does not detect the lever, wherein in a case where the lever is positioned at the detection position, the sensor detects the lever and detects that the developing roller is positioned at the separation position.

2. The image forming apparatus according to claim 1, wherein in a case where print operation of the image forming apparatus is monochromatic print, the separation mechanism causes the developing roller to be positioned at the separation position, wherein in a case where the print operation of the image forming apparatus is the monochromatic print and the sensor does not detect that the developing roller is positioned at the separation position in the determination process, the controller stops the image formation operation.

3. The image forming apparatus according to claim 1, further comprising:

a developing cartridge including the developing roller; and a frame including the photosensitive drum, the developing cartridge being capable of detachably attachable to the frame, wherein the separation mechanism is configured to move the developing cartridge relative to the photosensitive drum between a first position and a second position, wherein in a case where the developing cartridge is positioned at the first position, the developing roller is positioned at the contact position, wherein in a case where the developing cartridge is positioned at the second position, the developing roller is positioned at the separation position.

4. The image forming apparatus according to claim 1, wherein the controller is configured to further perform:

in a case where the sensor does not detect that the developing roller is at the separation position in the determination process, a re-transmission process transmitting again to the motor a command to drive the separation mechanism; and a re-determination process determining whether or not the sensor detects that the developing roller is positioned at the separation position within a predetermined period of time after the command is transmitted in the re-transmission process, wherein in a case where the sensor does not detect that the developing roller is positioned at the separation position in the re-transmission process, the stop process stops the image formation operation.

5. An image forming apparatus comprising:

a photosensitive drum;

a developing roller;

a separation mechanism configured to move the developing roller from a contact position to a separation position, at the contact position a surface of the developing roller being in contact with a surface of the photosensitive drum, at the separation position the surface of the developing roller being separated from the surface of the photosensitive drum;

a lever movable from a detection position to a non-detection position in a case where the developing roller is moved from the contact position to the separation position, a motor configured to cause the separation mechanism to operate;

a sensor configured to detect whether the developing roller is at the separation position;

a controller electrically connected to the sensor and the motor and configured to execute:

a transmission process transmitting to the motor a command to drive the separation mechanism;

a determination process determining whether or not the sensor detects that the developing roller is positioned at the separation position within a predetermined period of time after the command is transmitted in the transmission process; and a stop process stopping image formation operation in a case where the sensor does not detect that the developing roller is positioned at the separation position, wherein in a case where the lever is positioned at the non-detection position, the sensor does not detect the lever and detects that the developing roller is positioned at the separation position, wherein in a case where the lever is positioned at the detection position, the sensor detects the lever and detects that the developing roller is positioned at the contact position.

6. An image forming apparatus comprising:

a photosensitive drum;

a developing roller;

a separation mechanism configured to move the developing roller from a contact position to a separation position, at the contact position a surface of the developing roller being in contact with a surface of the photosensitive drum, at the separation position the surface of the developing roller being separated from the surface of the photosensitive drum;

a lever movable from a non-detection position to a detection position in a case where the developing roller is moved from the contact position to the separation position;

a motor configured to cause the separation mechanism to operate;

a sensor configured to detect whether the developing roller is at the separation position;

a controller electrically connected to the sensor and the motor and configured to execute:

a transmission process transmitting to the motor a command to drive the separation mechanism;

a determination process determining whether or not the sensor detects that the developing roller is positioned at the separation position within a predetermined period of time after the command is transmitted in the transmission process; and a print process executing image formation operation in a state where a predetermined image formation function is limited in a case where the sensor does not detect that the developing roller is positioned at the separation position, wherein in a case where the lever is positioned at the non-detection position, the sensor does not detect the lever, wherein in a case where the lever is positioned at the detection position, the sensor detects the lever and detects that the developing roller is positioned at the separation position.

7. The image forming apparatus according to claim 6, wherein in a case where print operation of the image forming apparatus is monochromatic print, the separation mechanism causes the developing roller to be positioned at the separation position, wherein in a case where the print operation of the image forming apparatus is the monochromatic print and the sensor does not detect that the developing roller is positioned at the separation position in the determination process, the controller executes the print process.

8. The image forming apparatus according to claim 6, further comprising:

a developing cartridge including the developing roller; and a frame including the photosensitive drum, the developing cartridge being capable of detachably attachable to the frame, wherein the separation mechanism is configured to move the developing cartridge relative to the photosensitive drum between a first position and a second position, wherein in a case where the developing cartridge is positioned at the first position, the developing roller is positioned at the contact position, wherein in a case where the developing cartridge is positioned at the second position, the developing roller is positioned at the separation position.

9. The image forming apparatus according to claim 6, wherein the controller is configured to further perform:

in a case where the sensor does not detect that the developing roller is at the separation position in the determination process, a re-transmission process transmitting again to the motor a command to drive the separation mechanism; and a re-determination process determining whether or not the sensor detects that the developing roller is positioned at the separation position within a predetermined period of time after the command is transmitted in the re-transmission process, wherein in a case where the sensor does not detect that the developing roller is positioned at the separation position in the re-transmission process, the print process executes the image formation operation using the photosensitive drum and the developing roller in the state where the predetermined image formation function is limited.

10. The An image forming apparatus comprising:

a photosensitive drum;

a developing roller;

a separation mechanism configured to move the developing roller from a contact position to a separation position, at the contact position a surface of the developing roller being in contact with a surface of the photosensitive drum, at the separation position the surface of the developing roller being separated from the surface of the photosensitive drum;

a lever movable from a detection position to a non-detection position in a case where the developing roller is moved from the contact position to the separation position;

a motor configured to cause the separation mechanism to operate;

a sensor configured to detect whether the developing roller is at the separation position;

a controller electrically connected to the sensor and the motor and configured to execute:

a transmission process transmitting to the motor a command to drive the separation mechanism;

a determination process determining whether or not the sensor detects that the developing roller is positioned at the separation position within a predetermined period of time after the command is transmitted in the transmission process; and a print process executing image formation operation in a state where a predetermined image formation function is limited in a case where the sensor does not detect that the developing roller is positioned at the separation position, wherein in a case where the lever is positioned at the non-detection position, the sensor does not detect the lever and detects that the developing roller is positioned at the separation position, wherein in a case where the lever is positioned at the detection position, the sensor detects the lever and detects that the developing roller is positioned at the contact position.

* * * * *